US008209783B1

(12) United States Patent
Lone Eagle

(10) Patent No.: US 8,209,783 B1
(45) Date of Patent: Jul. 3, 2012

(54) HELMET VISOR WITH WIPER APPARATUS

(76) Inventor: N. D. Lone Eagle, Northglenn, CO (US)

( * ) Notice: Subject to any disclaimer, the term of this patent is extended or adjusted under 35 U.S.C. 154(b) by 232 days.

(21) Appl. No.: 12/755,492

(22) Filed: Apr. 7, 2010

(51) Int. Cl.
*A42B 1/24* (2006.01)

(52) U.S. Cl. ..... 2/422; 2/424; 15/250.001; 15/250.3

(58) Field of Classification Search ..... 2/9, 10, 2/422, 424, 438; 15/250.001, 250.31, 250.3, 15/250.27, 250.37, 250.18; 351/158
See application file for complete search history.

(56) References Cited

U.S. PATENT DOCUMENTS 1,839,175 A * 12/1931 Hueber ..... 15/250.3
2,329,757 A * 9/1943 Greenfield ..... 15/250.28
2,721,352 A * 10/1955 Oishei ..... 15/250.12
2,737,658 A * 3/1956 Poeder ..... 2/9
2,888,703 A * 6/1959 Karwowska ..... 15/250.27
3,754,298 A * 8/1973 Menil ..... 15/250.3
4,027,354 A * 6/1977 Burpee ..... 15/250.3
4,215,437 A * 8/1980 Kao ..... 2/424
4,633,532 A * 1/1987 Yagasaki ..... 2/424
D311,792 S 10/1990 Gallet
6,077,361 A * 6/2000 Glenn ..... 134/21
6,640,379 B1 * 11/2003 Scribner ..... 15/250.3
6,698,032 B1 * 3/2004 Robertson ..... 2/424
2007/0283485 A1 12/2007 Tseng
2008/0184464 A1 8/2008 Chen
2008/0229536 A1 9/2008 Monpain

* cited by examiner

*Primary Examiner* — Katherine Moran
*Assistant Examiner* — Richale Quinn

(57) ABSTRACT

The helmet visor with wiper apparatus provides a visor that can wipe inclement weather products off of the visor center section with a pendulum action wiper blade that is replaceable. The visor removably fits most existing helmets. The center section of the visor provides for less curvature than do the left section and right section, thereby providing for most efficient cleaning. The center section outward flares provide best all around visibility from the center section. Also, the wiper mechanism removably fastens to the visor, providing for inexpensive wiper mechanism replacement without having to replace the entire apparatus and further providing for the various components of the wiper mechanism to be serviced and replaced easily, without great expense. The flexible blade is replaceable.

6 Claims, 5 Drawing Sheets

HELMET VISOR WITH WIPER APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

The need for some form of visor wiper on helmets, such as the helmets used by motorcyclists, snowmobilers, and firefighters, for example, is recognized and understood. To date, though, very few such devices have been developed that will fit existing helmets. The few devices that might do not employ the features needed and currently desired. The present apparatus provides for fit to existing helmets and also provides advantages not heretofore seen in the art.

FIELD OF THE INVENTION

The helmet visor with wiper apparatus relates to helmets with visors and more especially to a visor with wiper apparatus that removably fits existing helmets.

SUMMARY OF THE INVENTION

The general purpose of the helmet visor with wiper apparatus, described subsequently in greater detail, is to provide a helmet visor with wiper apparatus which has many novel features that result in an improved helmet visor with wiper apparatus which is not anticipated, rendered obvious, suggested, or even implied by prior art, either alone or in combination thereof.

To attain this, the helmet visor with wiper apparatus provides a removable visor that can wipe inclement weather products off of the visor center with a pendulum action wiper blade that is replaceable. The visor importantly removably fits most existing helmets, thereby providing inexpensive protection by negating the need to buy a complete helmet with improved visor with wiper. The center section of the visor provides for less curvature than do the left section and right section, thereby providing for most efficient cleaning. The center section downwardly disposed outward flares provide best all around visibility from the center section. A horizontal strengthening rib is disposed downwardly and horizontally on the visor, proximal to the bottom. Importantly, the horizontal rib also provides a division between upper and lower visor, wherein the angle of the visor below the rib is provided in various configurations, even those providing outwardly angled air foils for best helmet/visor aerodynamics. Also of great importance is the wiper mechanism removably fastens to the visor. Due to this important feature, the wiper mechanism can be inexpensively replaced without having to replace the entire apparatus. Also, the various components of the wiper mechanism can be serviced and replaced easily, without great expense. The flexible blade is replaceable.

Thus has been broadly outlined the more important features of the improved helmet visor with wiper apparatus so that the detailed description thereof that follows may be better understood and in order that the present contribution to the art may be better appreciated.

An object of the helmet visor with wiper apparatus is to provide for wiping inclement weather products from a helmet visor.

Another object of the helmet visor with wiper apparatus is to provide a removable visor that wipes inclement weather products from a helmet visor.

A further object of the helmet visor with wiper apparatus is to provide a visor with removable wiper mechanism.

An added object of the helmet visor with wiper apparatus is to differentiate between the visor center and opposite side sections to ensure proper visor wiping and best user visibility.

And, an object of the helmet visor with wiper apparatus is to provide a reversing motor in wiping the visor.

These together with additional objects, features and advantages of the improved helmet visor with wiper apparatus will be readily apparent to those of ordinary skill in the art upon reading the following detailed description of presently preferred, but nonetheless illustrative, embodiments of the improved helmet visor with wiper apparatus when taken in conjunction with the accompanying drawings.

In this respect, before explaining the current embodiments of the improved helmet visor with wiper apparatus in detail, it is to be understood that the helmet visor with wiper apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved helmet visor with wiper apparatus. It is therefore important that the claims be regarded as including such equivalent constructions insofar as they do not depart from the spirit and scope of the helmet visor with wiper apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 5 thereof, the principles and concepts of the helmet visor with wiper apparatus generally designated by the reference number 10 will be described.

Figure 1:
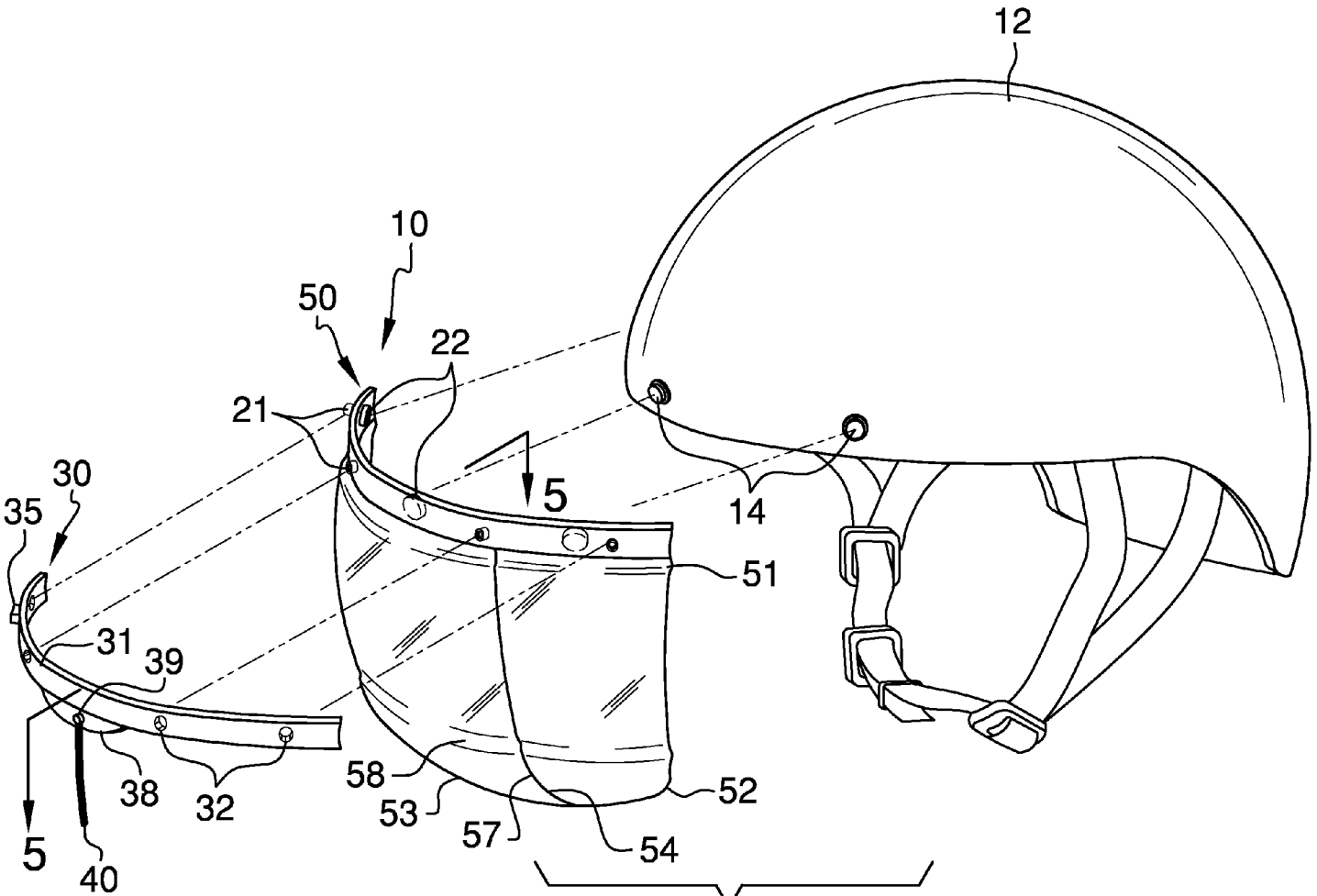
FIG. 1 is a left side perspective view of the apparatus and existing helmet to which it attaches.
Figure 5:
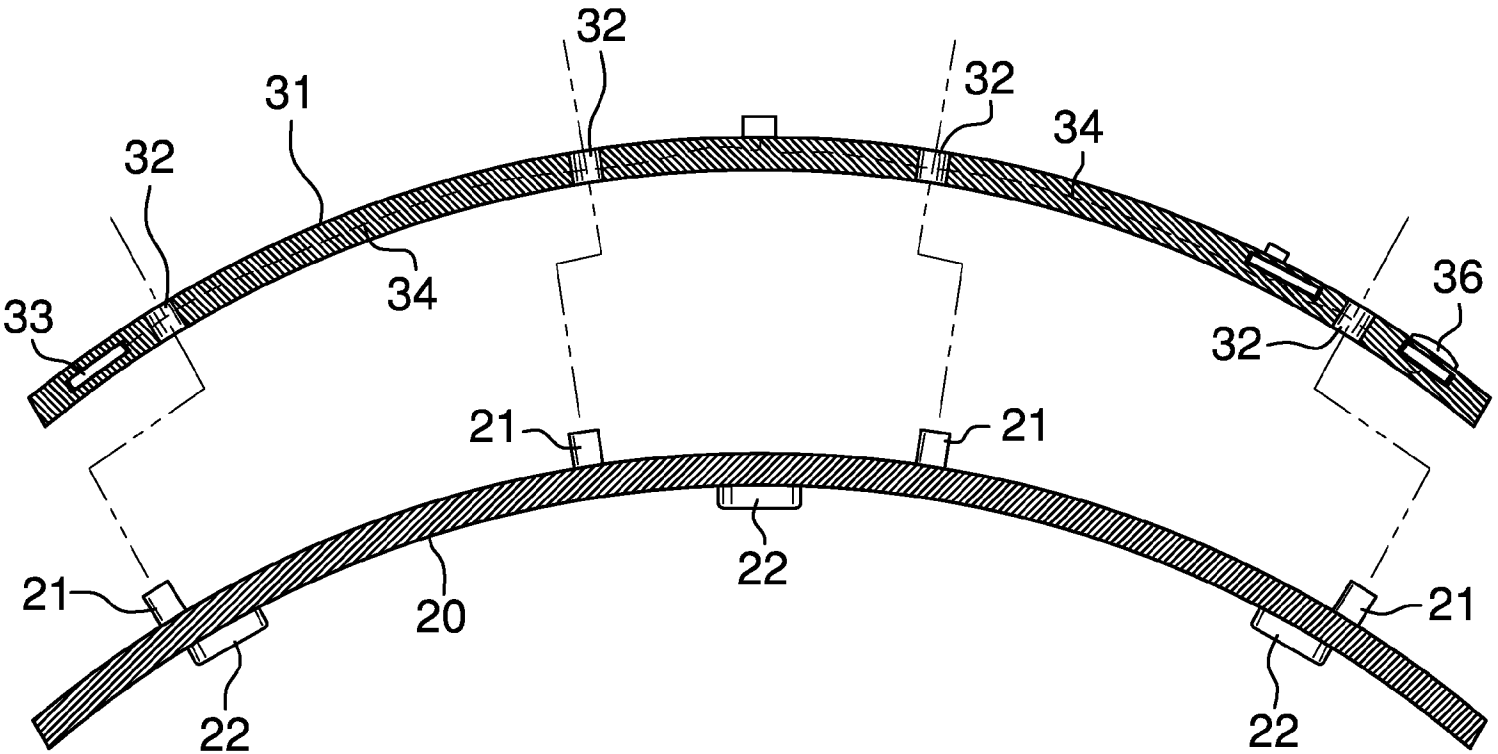
FIG. 5 is a partial cross sectional view of FIG. 1, taken along the line 5-5.

Referring to FIGS. 1 and 5, the apparatus 10 partially comprises the arc shaped top horizontal strip 20. The plurality of spaced apart studs 21 is disposed outwardly on the top horizontal strip 20. The plurality of spaced apart complimentary fasteners 22 is provided inwardly on the top horizontal strip 20. The complimentary fasteners 22 provide for removable attachment of the top horizontal strip 20 to a plurality of existing visor fasteners 14 on an existing helmet 12.

Referring to FIG. 3 and again to FIG. 1, the substantially arc shaped visor 50 has a top 51 spaced apart from a bottom 52. The top 51 is affixed to the top horizontal strip 20. The visor 50 comprises a center section 53 disposed between the left side section 55 and the right side section 56. The center section 53 has a minimized curvature 53*a* compared to the side sections. A rounded edge 57 disposed on each of the side section visor 50 bottoms 53. A pair of spaced apart opposed outward flares 54 is disposed on the center section 53 visor 50 bottom 52. One of each of the outward flares 54 is affixed to one of each of the rounded edges 57 of the side sections of the visor 50 bottom 52. The strengthening rib 58 is importantly disposed horizontally across the visor 50. The rib 58 is disposed proximal to the bottom 52.

Figure 2:
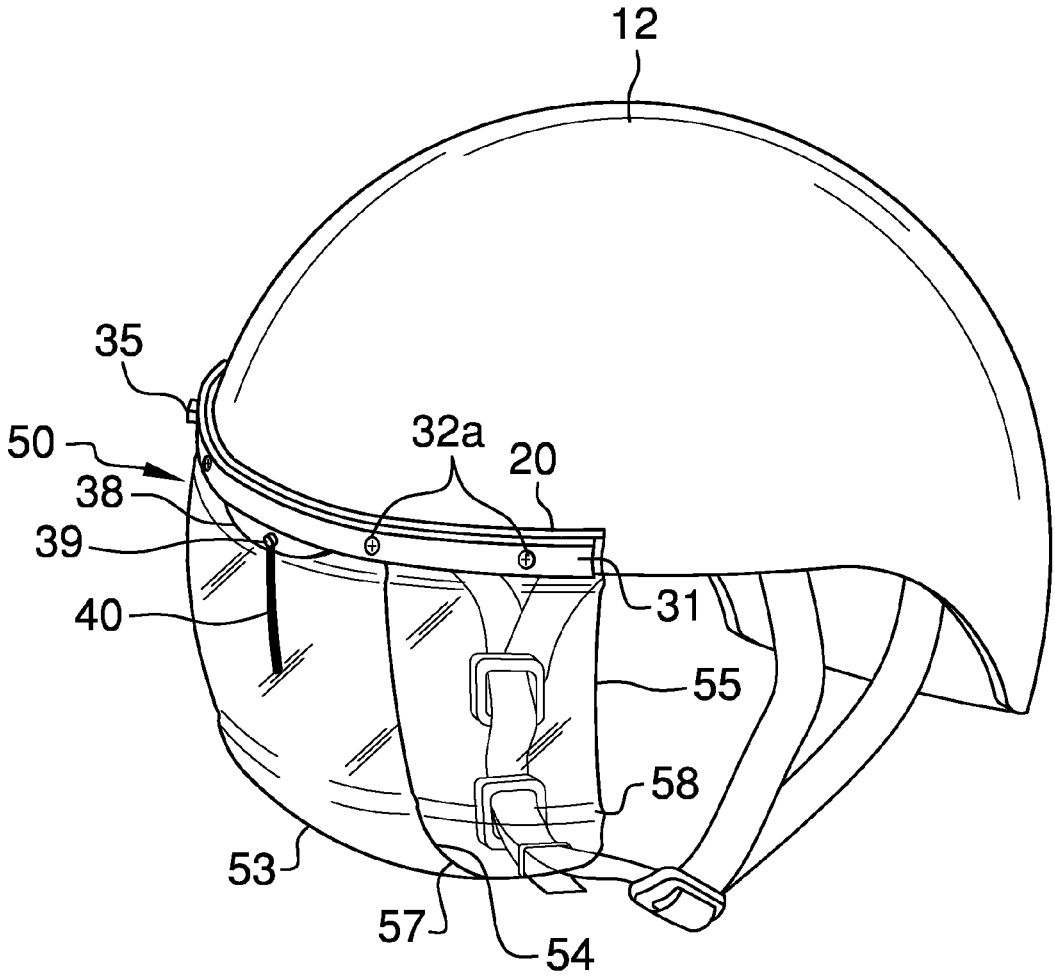
FIG. 2 is a left side perspective view of the apparatus installed.
Figure 3:
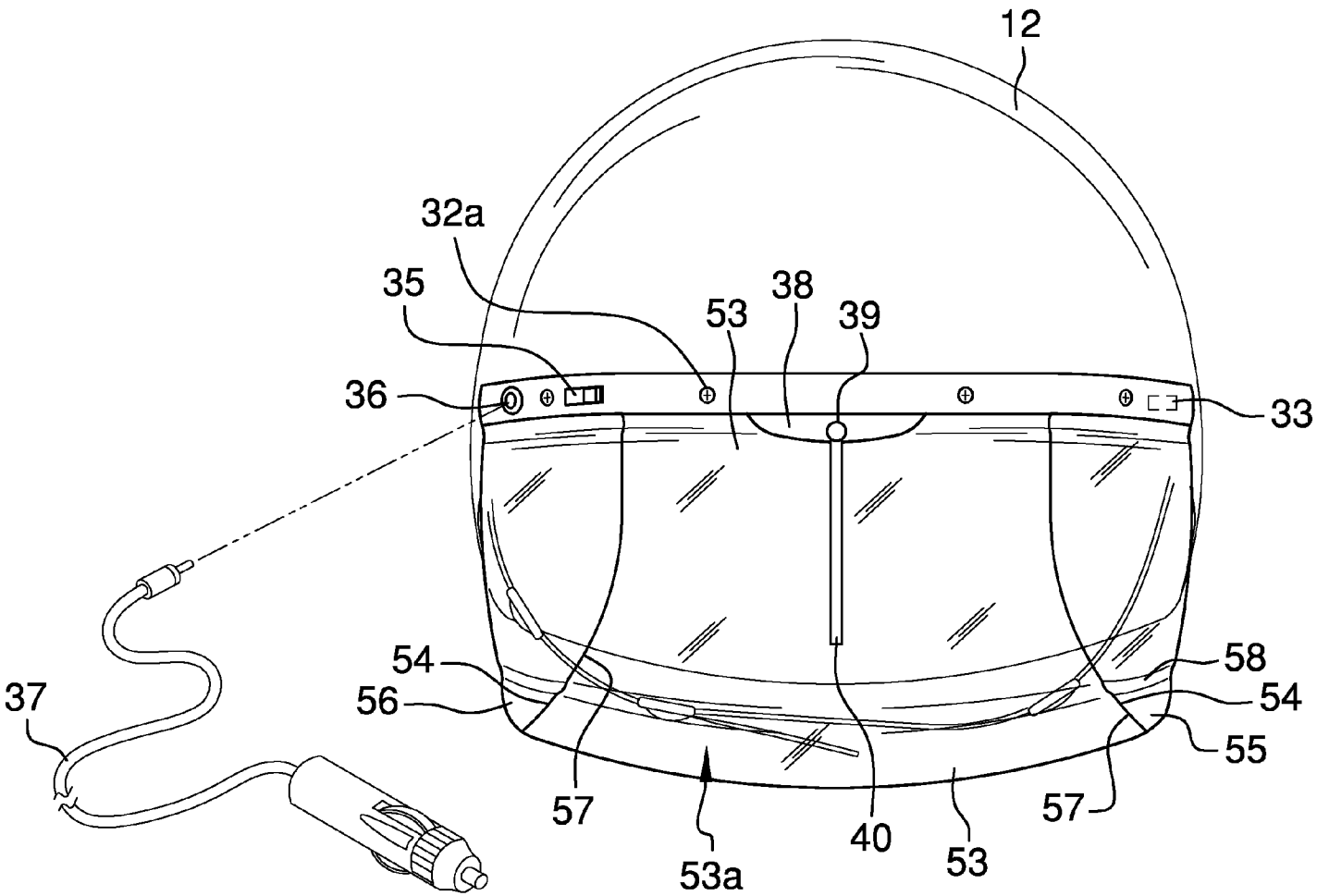
FIG. 3 is a front perspective view of the installed apparatus and removable power cord.
Figure 4:
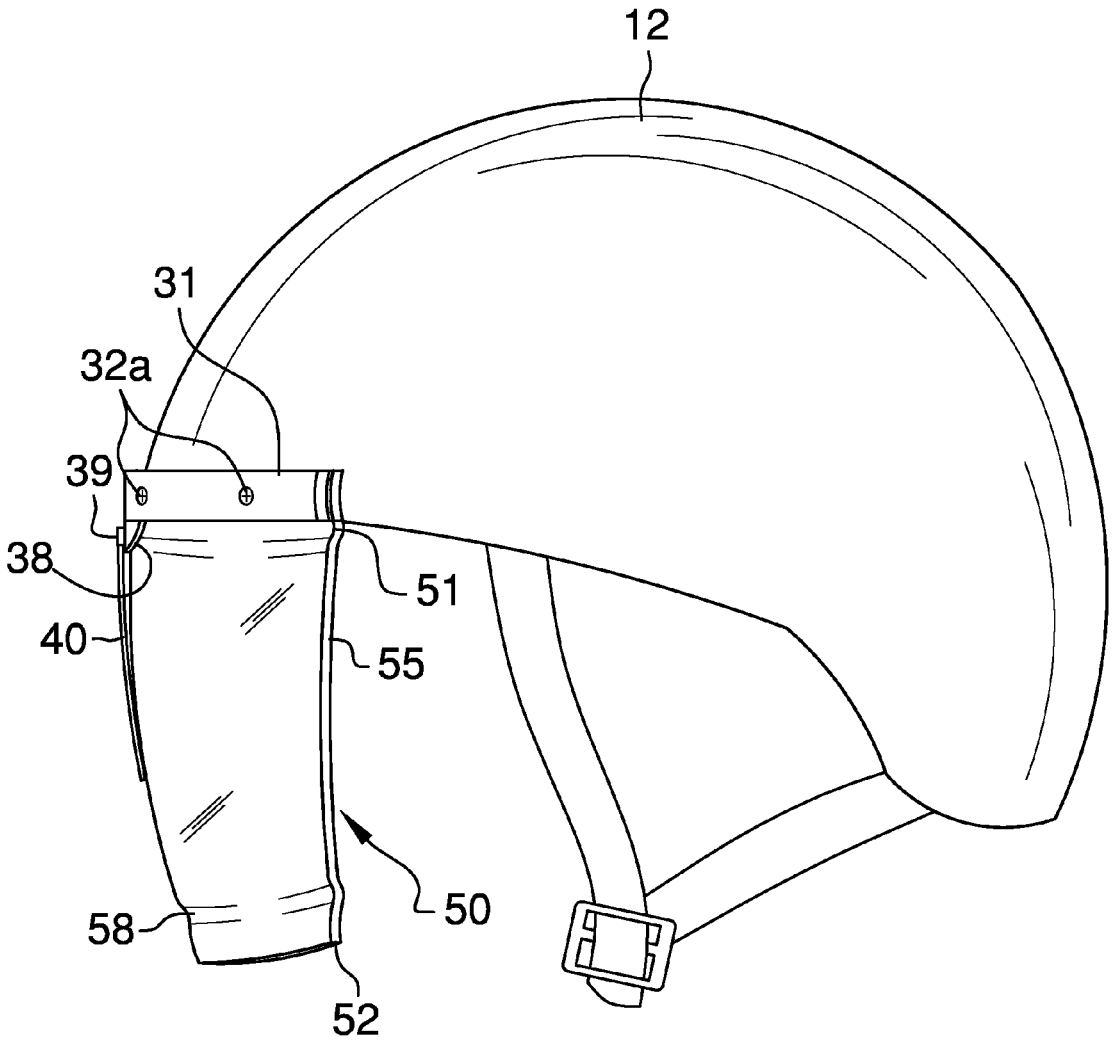
FIG. 4 is a left side elevation view of the installed apparatus.

Referring to FIGS. 2, 4, and 5, the wiper mechanism 30 partially comprises the arc shaped mechanism strip 31 that is removably affixed to the top horizontal strip 20 studs 21 via the fasteners 32*a* that pass through the fastener holes 32. The control 35 is disposed in the mechanism strip 31. The electrical jack 36 is disposed in the mechanism strip 31. The semicircular shaped motor housing with reciprocal motor 38 is extended downwardly and centrally from the mechanism strip 31. The axle 39 is extended forwardly and importantly only slightly from the motor housing with reciprocal motor 38. The axle 39 is reciprocally rotated in about a 180 degree movement by virtue of the control 35. The removable flexible blade 40 is extended downwardly from the axle 39 and contacts the visor 50 center section 53. The battery compartment 33 is disposed within the mechanism strip 31. The battery compartment 33 is in communication with the control 35, the electrical jack 36, and the motor housing with reciprocal motor 38 via the electrical connections 34. The power cord 37 removably plugs into the electrical jack 36. The power cord 37 is provided in various embodiments so that detachable connection is provided for various electrical outlets, such as cigar lighters for example.

Again referring to FIGS. 1 and 5, the importance of the removability of the wiper mechanism 30 from the visor 50 cannot be overstated. Failure of the motor housing with reciprocal motor 38, for example, allows modular replacement without having to replace the entire apparatus 10.

Referring again to FIG. 3, the power cord 37 and the battery compartment 33 allow the apparatus 10 to be operated by battery or by plug in of the power cord 37. Additionally, the power cord 37 recharges the battery compartment 33 when plugged into a power outlet. Power cords 37 with various types of power plug in capabilities are provided.

With respect to the above description then, it is to be realized that the optimum dimensional relationships for the parts of the helmet visor with wiper apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the helmet visor with wiper apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the helmet visor with wiper apparatus may be used.

Therefore, the foregoing is considered as illustrative only of the principles of the helmet visor with wiper apparatus. Further, since numerous modifications and changes will readily occur to those skilled in the art, it is not desired to limit the helmet visor with wiper apparatus to the exact construction and operation shown and described, and accordingly, all suitable modifications and equivalents may be resorted to, falling within the scope of the helmet visor with wiper apparatus.

What is claimed is:

1. A helmet visor with wiper apparatus comprising, in combination:

an arc shaped top horizontal strip;

a plurality of spaced apart complimentary fasteners disposed on the horizontal strip, the complimentary fasteners removably attached to a plurality of existing visor fasteners of an existing helmet;

a substantially arc shaped visor having a top spaced apart from a bottom, the top affixed to the top horizontal strip;

a wiper mechanism comprising:

an arc shaped mechanism strip affixed to the top horizontal strip;

a control disposed within the mechanism strip;

a electrical jack disposed within the mechanism strip;

a semicircular shaped motor housing with reciprocal motor extended downwardly and centrally from the mechanism strip;

an axle extended forwardly from the motor housing with reciprocal motor, the axle reciprocally rotated in about a 180 degree movement;

a removable flexible blade extended downwardly from the axle, the blade in movable contact with the visor center section;

a battery compartment disposed within the mechanism strip, the battery compartment in communication with the control, the electrical jack, and the motor housing with reciprocal motor.

2. The apparatus according to claim 1 wherein the visor further comprises a horizontally disposed rib proximal to the visor bottom.

3. The apparatus according to claim 2 wherein the visor further comprises a center section disposed between a left side section and a right side section;

a rounded edge disposed on each of the side section visor bottoms;

a pair of spaced apart opposed outward flares disposed on the center section visor bottom, one of each of the outward flares affixed to one of each of the rounded edges of the side section visor bottom.

4. The apparatus according to claim 1 wherein the visor further comprises a center section disposed between a left side section and a right side section;

a rounded edge disposed on each of the side section visor bottoms;

a pair of spaced apart opposed outward flares disposed on the center section visor bottom, one of each of the outward flares affixed to one of each of the rounded edges of the side section visor bottom.

5. A helmet visor with wiper apparatus comprising, in combination:

an arc shaped top horizontal strip;

a plurality of spaced apart studs disposed outwardly on the top horizontal strip;

a plurality of spaced apart complimentary fasteners disposed inwardly on the horizontal strip, the complimentary fasteners removably attached to a plurality of existing visor fasteners of an existing helmet;

a substantially arc shaped visor having a top spaced apart from a bottom, the top affixed to the top horizontal strip, the visor comprising a center section disposed between a left side section and a right side section, the center section having a minimized curvature compared to the side sections;

a rounded edge disposed on each of the side section visor bottoms;

a pair of spaced apart opposed outward flares disposed on the center section visor bottom, one of each of the outward flares affixed to one of each of the rounded edges of the side section visor bottom;

a wiper mechanism comprising:

an arc shaped mechanism strip removably affixed to the top horizontal strip studs;

a control disposed within the mechanism strip;

a electrical jack disposed within the mechanism strip;

a semicircular shaped motor housing with reciprocal motor extended downwardly and centrally from the mechanism strip;

an axle extended forwardly from the motor housing with reciprocal motor, the axle reciprocally rotated in about a 180 degree movement;

a removable flexible blade extended downwardly from the axle, the blade in movable contact with the visor center section;

a battery compartment disposed within the mechanism strip, the battery compartment in communication with the control, the electrical jack, and the motor housing with reciprocal motor.

6. The apparatus according to claim 5 wherein the visor further comprises a horizontally disposed strengthening rib proximal to the visor bottom.

* * * * *